US005140622A

United States Patent [19]

Shino et al.

[11] Patent Number: 5,140,622

[45] Date of Patent: Aug. 18, 1992

[54] DATA TRANSMISSION SYSTEM WITH DOUBLE LINES

[75] Inventors: Shigehiro Shino; Kazuhiko Uemura; Kiyoshi Kurashita, all of Osaka, Japan

[73] Assignee: Idec Izumi Corporation, Osaka, Japan

[21] Appl. No.: 678,861

[22] Filed: Apr. 1, 1991

[30] Foreign Application Priority Data

Apr. 4, 1990 [JP] Japan ..... 2-91048

[51] Int. Cl.[5] ..... G08B 1/08; G08C 19/02; G08C 13/02

[52] U.S. Cl. ..... 377/20; 340/505; 340/506; 340/508; 340/664

[58] Field of Search ..... 377/20; 324/133, 525; 340/505, 506, 508, 518, 664

[56] References Cited

U.S. PATENT DOCUMENTS 3,967,259 6/1976 Lecuyer ..... 340/508
4,468,746 8/1984 Davis ..... 377/20
4,536,748 8/1985 Tonello ..... 340/506
4,603,318 7/1986 Philp ..... 340/505
4,612,534 9/1986 Buehler et al. ..... 340/505
4,745,398 5/1988 Abel et al. ..... 340/506

*Primary Examiner*—John S. Heyman
*Attorney, Agent, or Firm*—Graham & James

[57] ABSTRACT

A data transmission system with double lines comprises a plurality of sensor terminals connected to the current line in cascade, and a controller connected to a current input side of the first sensor terminal. A switch device in each sensor terminal connects the current line to a sensor circuit for a specified time after a current begins to flow to the current input side of the sensor terminal, and connects the current line to the current output side of the sensor terminal after an elapse of the specified time. After that switching, the current begins to flow to the next sensor terminal. If the sensor turns on while the current is flowing to the sensor circuit, the value of the current of the current line may be greater. The controller detects value of the current and decides state of the sensor circuit in the sensor terminal according to the value of the current.

10 Claims, 17 Drawing Sheets

DATA TRANSMISSION SYSTEM WITH DOUBLE LINES

BACKGROUND OF THE INVENTION

1. Field of the Invention

The present invention relates to data transmission systems for use in a disaster-prevention or crime-prevention system, robot control or the like.

2. Prior Art

A data transmission system such as a remote sensing system consists of a controller, terminals installed at any desired places, and transmission lines for connecting the terminals with the controller, in which the system collects and processes data obtained by each terminal at the controller and, in turn, transmits data from the controller to each terminal. In such a remote sensing system, in general, data has been transmitted between the controller side and the sensor terminal side by the method of multiplexing signals. That is, frequency division or time division has been used to realize the multiplex transmission of signals.

However, the data transmission system using multiplex transmission necessitates providing a transmission control section to both the controller side and each sensor terminal side, resulting in very high cost.

SUMMARY OF THE INVENTION

Accordingly, an essential object of the present invention is to provide a novel data transmission system that utterly eliminates the need of such transmission control sections as mentioned above.

To this end, according to the present invention, there is provided a data transmission system with double lines comprising:

a plurality of sensor terminals connected to a current line in cascade;

each sensor terminal including;

(a) a sensor;

(b) a sensor circuit for changing an impedance depending on state of the sensor;

(c) a branch current line connected to the current line; and (d) switch means for connecting the current line to the sensor circuit for a specified time after a current begins to flow through a current line to a current output side of the sensor terminal after an elapse of the specified time; and a controller connected to a current input side of the first sensor terminal;

the controller including;

(a) a current source for supplying a current to the current line;

(b) current detection means for detecting value of the current; and (c) means for deciding state of the sensor circuits in the sensor terminals.

According to the present invention, it is unnecessary to provide transmission control sections on the controller side and the sensor terminal side as in conventional systems. This advantageously allows the system to be constructed at very low cost and with simplicity. Moreover, since current flowing through a current line can be made direct current, it will never be affected by noise that is generated on the line from external, so that a highly accurate detection can be performed.

As another advantage of the invention, the arrangement thereof is such that while one sensor terminal is under sensing, the sensor circuits of the other sensor terminals have no current flow therethrough, involving no wasteful power loss. This simplifies the arrangement on the controller side and also permits a large number of sensor terminals to be connected to the controller.

Furthermore, by separating the sensor in connection, the sensor terminals can be used as an input/output unit or an output unit.

BRIEF DESCRIPTION OF THE DRAWINGS

These and other objects and features of the present invention will become apparent from the following description taken in conjunction with the preferred embodiments thereof with reference to the accompanying drawings, in which.

DESCRIPTION OF THE PREFERRED EMBODIMENTS OF THE INVENTION

Figure 1:
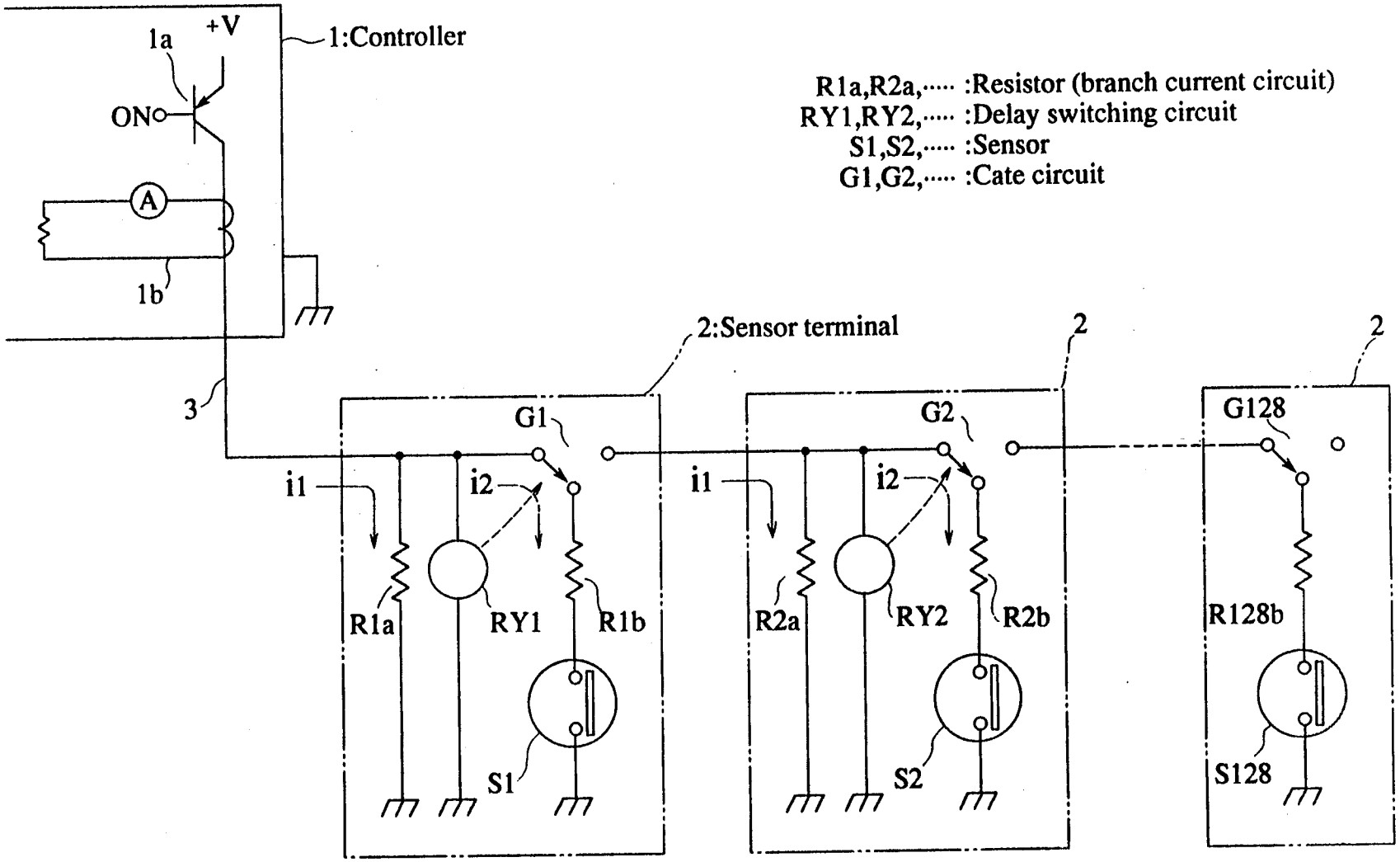
FIG. 1 is a view showing the arrangement of an embodiment of the present invention.

FIG. 1 illustrates the arrangement of a remote sensing system to which a data transmission system of the present invention is applied. In the figure, reference numerals 1 and 2 denote a controller and sensor terminals, respectively, in which each sensor terminal 2 is connected to the controller 1 in cascade through a two-wire current line 3.

The sensor terminal 2 comprises a gate circuit G1, G2, . . . for switchably connecting the current source side (upstream side) of the current line 3 either to the sensor circuit side, the sensor circuit being provided by a series circuit of a resistor R1b, R2b, . . . and a sensor S1, S2, . . . for its inactive state, or to the load side (downstream side), i.e. the succeeding-stage sensor terminal side for its active state; a branch current circuit provided by R1a, R2a, . . . for branching the current that flows through the current line 3; and a delay switching circuit RY (RY1, RY2, . . .) consisting of, for example, relays for actuating the gate circuit G (G1, G2, . . .) with the delay of a specified time after the branch current circuit is energized so that the current source side is connected to the load side. The controller 1, on the other hand, comprises a current source 1*a* for supplying current to the current line 3 and a current detector circuit lb for detecting the amount of current that flows through the current line 3.

In a remote sensing system arranged as described above, when an ON-signal is issued to the current source 1*a* of the controller 1, first a current i1 flows through the branch current circuit of the sensor terminal 2 that is the closest to the controller 1, i.e. through the resistor R1a. At the same time, the current flows also through the delay switching circuit RY1, causing the circuit to be actuated. Further, the gate circuit G1 is, at this point, in the inactive state so as to permit a current to flow through the sensor circuit provided by the resistor R1b and the sensor S1. If the sensor S1 is in the OFF state in this case, the current i2 will not flow. This means that if the current flowing through the delay switching circuit RY1 is disregarded, the current i1 flowing through the resistor R1a, a branch current circuit is the only current that flows in the sensor terminal 2.

Next, when the delay switching circuit RY1 actuates the gate circuit G1 after the delay of a specified time, the gate circuit G switches over to connect the current source side of the current line 3 to the load side, i.e. the succeeding-stage sensor terminal side. Then, the current i1 flows across the resistor R2a, the branch current circuit of the sensor terminal 2 on the second stage, while a driving current flows through the delay switching circuit RY2. In this second-stage sensor terminal 2 also, if the sensor S2 is in the OFF state, the current i1 is the only current that flows in the sensor terminal 2. Accordingly, when both the sensors S1 and S2 are in the OFF state, the current flows through the current line 3 is il+il. After an elapse of a specified time from when the current i1 begins to flow across the resistor R2a, the gate circuit G2 switches over so as to be connected to the load side, causing the current i1 to subsequently flow through the branch current circuit of the third-stage sensor terminal. And thereafter, like operation will be repeated.

Figure 2A:
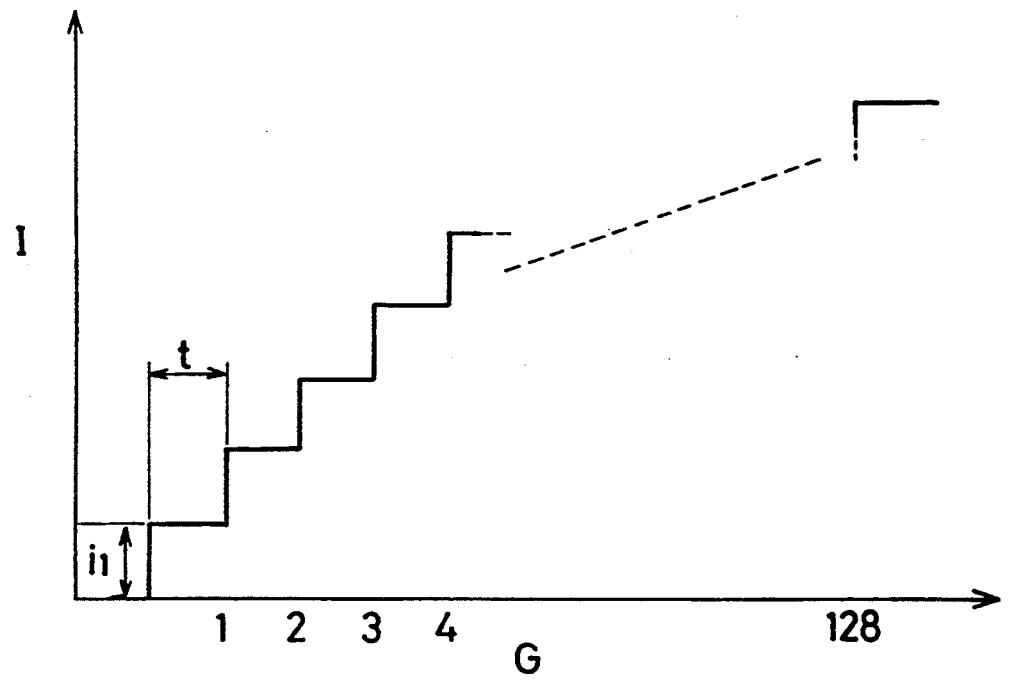
FIG. 2 is a view for explaining the operation of the same embodiment.
Figure 2B:
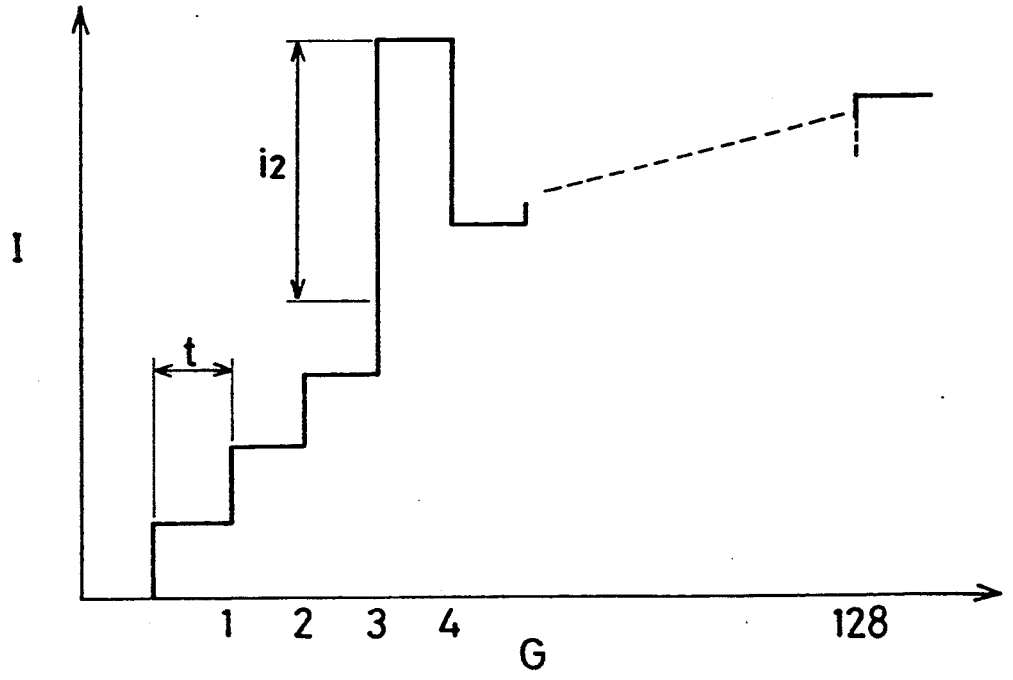

FIG. 2 (A) illustrates variation in current that flows through the current line 3 while all of the 128 sensors are in the OFF state. With the resistance value of the branch current circuit (R1a, R2a, . . .) of each sensor terminal 2 set to be a specified one, the amount of current that flows through the current line 3 will increase in steps for every specified delay time, as shown in the figure. When the nth gate circuit Gn is actuated, the resulting current that flows through the current line 3 is $$I=(V / Rx)\times n$$

where Rx=R1a=R2a=. . .=R128a. On the other hand, if in one sensor terminal 2 the sensor S is in the ON state, the current i2 will flow for a duration of a specified time t after the branch current circuit of the sensor terminal 2 has a current flow therethrough. Now assuming that in the fourth sensor terminal including the gate circuit G4 the sensor S4 is in the ON state, the variation in current that flows through the current line 3 is as shown in FIG. 2 (B). More specifically, when the gate circuit G of the third-stage sensor terminal 2 is actuated so that a current flows in the fourth. stage sensor terminal 2, the amount of a current I flowing through the current line 3 increases by the current i2. When a current begins to flow in the first sensor terminal 2 (on the nth stage) out of those the sensors of which have been in the ON state after the current source 1*a* is turned on so that a current begins to flow through the current line 3, the current I flowing through the current line 3 will be $$I=(V / Rx)\times n+V / Rs$$

where Rs=R1b=R2b=. . .=R128b)

From the above operation, the controller 1 detects the current that will increase for every specified time t after the current source 1*a* is turned on, and when it detects that the current I increases at a time point by an amount of the current i2, it accordingly detects the position of the sensor terminal 2 on the final stage in which a current is flowing at that time. For example, in the case as shown in FIG. 2 (B), the controller 1 detects that the sensor S4 of the sensor terminal 2 including the gate circuit G4 is in the ON state.

As this is the case, if the sensor S is in the ON state in one sensor terminal 2, a current of an amount equal to the sum of i2 and i1 will flow in the sensor terminal 2; however, since the gate circuit G is actuated after an elapse of the specified time t so that the current source side of the current line 3 is connected to the load side, the current i2 will no longer flow after the switched connection. This causes the current I flowing through the current line 3 to drop at the step at which the current source 1*a* is connected to the succeeding-state sensor terminal 2 as shown in FIG. 2 (B). As a result of this, the current source 1*a* is connected to the final-stage sensor terminal 2, and when the gate circuit G is actuated in the final-stage sensor terminal 2, the resulting current I amounts to $$I=(V / Rx)\times(\text{number of sensor terminals})$$

If V is 24V, Rx is 24 KΩ, and the number of sensor terminals is 64, then the current I after an elapse of the specified time t from when the current source 1*a* is connected to the final-stage sensor terminal 2 will be, irrespectively of a line impedance, $$I=(24V / 24\ K\Omega)\times 64=64\ mA$$

Since, according to the above operation, the current i2 will never flow simultaneously in a plurality of sensor terminals 2, the consequent maximum current IMAX that flows through the current line 3 will be $$IMAX=(24V / 24\ K\Omega)\times 64+(24V / 120\ \Omega)=64\ mA+200\ mA=264\ mA$$

As seen from this, the maximum current flowing through the current line 3 from the controller 1 will not increase to a considerable amount. This is because the current i2 will never flow simultaneously in each sensor terminal 2 as described before. Such an amount of current as above can be supplied sufficiently by the current source 1*a*.

In the controller 1, after an elapse of the specified time t from when the current source 1*a* is connected to the final-stage sensor terminal, the current source 1*a* is once turned on and moreover again on; then, the above operation will be repeated once more from the beginning.

According to the operation as described above, the controller 1 and sensor terminal 2 require no transmission control section such as conventionally used, allowing themselves to be of a very simple construction and low cost.

What is more, according to the data transmission system of the present invention, when the current source on the controller side is driven, first in the first-stage sensor terminal closest to the controller the first gate circuit is turned on for a specified time T1, causing a current to be supplied to the sensor circuit side of the first-stage sensor terminal. Since the sensor circuit is subject to variation in its circuit impedance depending on the operating state of the sensor, the current flowing through the current line in the above-mentioned state will be of an amount corresponding to the operating state of the sensor.

When the specified time T1 has elapsed, the first gate circuit closes, causing the current to be no longer supplied to the sensor circuit side. Then, after a further elapse of time until a specified time t2 (T2>T1) from when the current source side of the current line of the relevant sensor terminal is connected to the current source, the second gate circuit opens. The opening of the second gate circuit causes the current source side to be connected to the load side, that is, the current source is connected to the sensor terminal side on the succeeding stage. Now that the current source is connected to the second-stage sensor terminal, the first gate circuit of the second-stage sensor terminal opens again for a duration of the specified time T1, causing the current to be supplied to the sensor side. And thereafter, the above operation will be repeated.

In consequence, the controller detects the current that flows through the sensor circuit in the first-, second-, third-, . . . , and nth-stage sensor terminal for every specified time T2 after the controller begins to supply a current to the first sensor terminal. In other words, the controller can sense the operating state of the sensors in the terminals in order starting with the first sensor terminal according to the amount of current.

Moreover, in the above sensing method, while the operating state of the sensor of one sensor terminal is being detected, a current will never flow through the sensor circuits of the rest of the sensor terminals. Accordingly, even while sensing is performed in a sensor terminal substantially apart from the controller, the current flowing through the current line can be small in amount. Thus, it follows that the drop voltage in the second gate circuit also can be small and that the number of connectable sensor terminals can be substantially great. Further, according to the present invention, when the current source on the controller side is driven, the first gate circuits are turned on for a duration of the specified time T1 in order starting with that of the sensor terminal closer to the controller, during which the current source side is connected to the sensor circuit side. In this state, if output data is put out from the controller via the data transmission line, the output data is entrapped into an output circuit, the output being varied depending on the output data.

If the sensor forming a sensor circuit remains connected, the state of current in the sensor circuit is detected on the controller side, so that the operating state of the sensor connected to each sensor terminal also can be detected, allowing the transmission system to be used as an input/output unit. If the sensor is removed, on the other hand, the transmission system can be used as an output unit for only putting out data from the output circuit.

The present invention further provides a data transmission system in which the output circuit comprises output data detection means and output signal switching circuit. With this arrangement, output data put out from the controller via the data transmission line is detected by the output data detection means. When this output data detection means detects output data, an output switching signal is produced by an output signal switching circuit. In this case, the output signal switching circuit is supplied with current in a line other than the data transmission line, so that a voltage applied to the output signal switching circuit will not affect input-/output data transmitted via the data transmission line, enabling correct input/output of data into and from each sensor terminal.

The present invention provides still further data transmission system in which the aforementioned second gate circuit is provided by a switch element of MOSFET. The MOSFETs are available in substantially smaller ON-state resistances in comparison with transistors. Use of such a MOSFET that has a smaller ON-state resistance only requires a voltage drop smaller than in use of a transistor. Moreover, since the gate current for turning on the MOSFET is only required to be far smaller than that for transistors, the value of current flowing through the current line is smaller as well.

The present invention provides even another data transmission system in which a terminal block is provided by a singularity or plurality of sensor terminals integrally. With this arrangement, the number of parts involved can be reduced so that the sensor terminal side can be constructed to a small size and that the installation work can be simplified.

Figure 3:
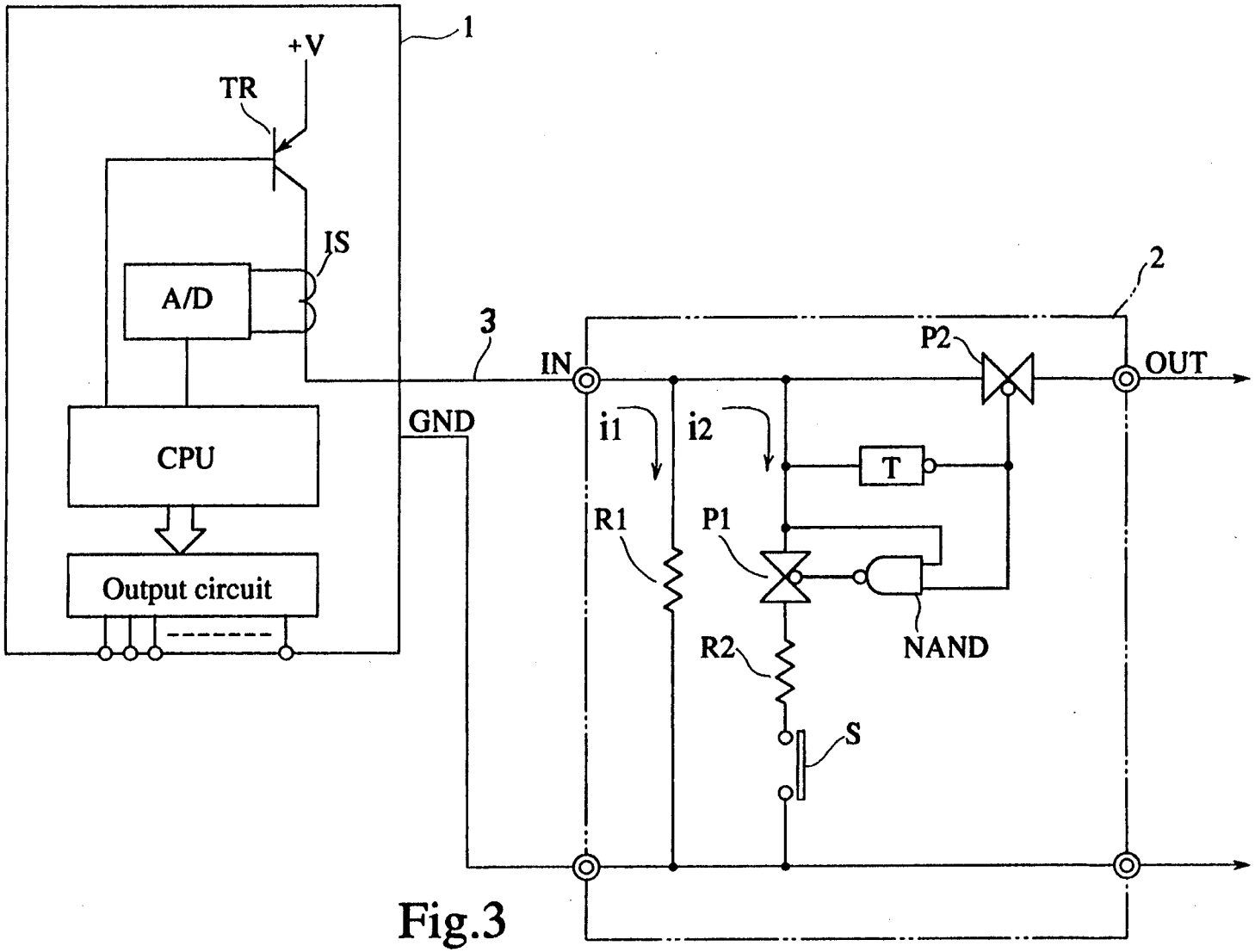
FIG. 3 is a view showing the arrangement of another embodiment of the invention.

FIG. 3 illustrates the arrangement of another embodiment of the data transmission system according to the present invention.

A controller 1 comprises a transistor TR for supplying a current to a current line 3; a current sensor IS for detecting the amount of the current that flows through the current line 3; an A/D (analog-to-digital) converter for A/D converting sensor output; and a CPU. The CPU puts out an ON signal to the transistor TR when starting a sensing cycle. It also reads, as described later, the value of A/D conversion for every elapse of the set time interval of a timer (equivalent to the delay time of the present invention) provided to each sensor terminal, deciding the ON/OFF state of the sensor S in each sensor terminal 2 based on the amount of the value.

The sensor terminal 2 comprises a resistor R1 that provides a branch current circuit; an electronic switch Pl, P2 provided by, for example, a MOSFET; a gate circuit provided by a NAND gate; a timer T; and a sensor circuit provided by a series circuit composed of a resistor R2 and a sensor S.

With the above arrangement, when a voltage is applied to an input terminal IN, a current i1 flows across the resistor R1 while the NAND gate opens to turn on the electronic switch P1, causing the voltage to be applied also to the sensor circuit. At this point, if the sensor S is in the OFF state, the current i2 will not flow, but if in the ON state, the current i2 will. Meanwhile, due to the fact that the timer T has been actuated by the voltage applied to the input terminal IN, when the timer T runs out after a duration of a specified time, the electronic switch P2 turns on and at the same time the NAND gate closes so that the electronic switch P1 turns off. That is, the current source side of the current line 3, which has been connected to the sensor side, now turns to be connected to the load side. As a result of this, a voltage V appears at an output terminal OUT, being applied to the input terminal IN of the sensor terminal 2 on the succeeding stage. Likewise, thereafter, for each time interval after which the timer T counts up, the above operation will be repeated in each sensor terminal 2. In consequence, if the sensor S is in the OFF state in each sensor terminal 2, the current I flowing through the current line 3 will vary as shown in FIG. 2 (A).

In contrast, if a sensor Sn in the nth sensor terminal 2 is in the ON state, both the currents i1 and i2 will flow when a voltage is applied to the input terminal IN of the above-mentioned sensor terminal 2. Then, when the timer T runs out after an elapse of a specified time, only the current i1 flows through the sensor terminal 2, so that the switch P2 is put into the ON state. As in such a case, if the sensor Sn is in the ON state in the nth sensor terminal 2, variation in the current I flowing through the current line 3 goes like that shown in FIG. 2 (B).

The controller 1, which is monitoring the elapsing time with its internal timer after turning on the transistor TR, reads the value of A/D conversion for each set time of the timer T provided to each sensor terminal 2, deciding whether the value corresponds to the product of $i1 \times n$ or to that of $i1 \times n + i2$. Then, if it corresponds to the former, the controller 1 decides that the sensor S is in the OFF state in the nth-stage sensor terminal 2, and if to the latter, that the sensor S is in the OFF state in the nth- stage sensor terminal 2. It repeats this operation until the voltage is applied to the final-stage sensor terminal 2. When the above deciding operation is over with all the sensor terminals, the controller 1 turns off the transistor TR temporarily. As a result, the timer T is reset in each sensor terminal 2, thus initialized. As the controller 1 turns on the transistor TR again, it repeats the above operation sequentially from the first sensor terminal once more.

Through the above operation, the controller 1 reads the value of A/D conversion for each set time t of the timer T, and can detect the on/off state of the sensor S in each sensor terminal 2 by seeing the amount of the value. In addition, not only a timer may be used in the controller 1 to monitor the correspondence between the value of A/D conversion being read currently and the position (number) of the final-stage sensor terminal 2 to which the current source is connected, but also a counter may be used for that purpose. The counter, when used, should be adapted to continuously read the value of A/D conversion and count one on the leading edge at which the value abruptly increases.

The current that flows through the current line 3, as explained with reference to FIG. 1, will not increase to a considerably large amount. Therefore, the transistor TR, current line 3, and power supply are not required to be of large capacities.

Figure 4:
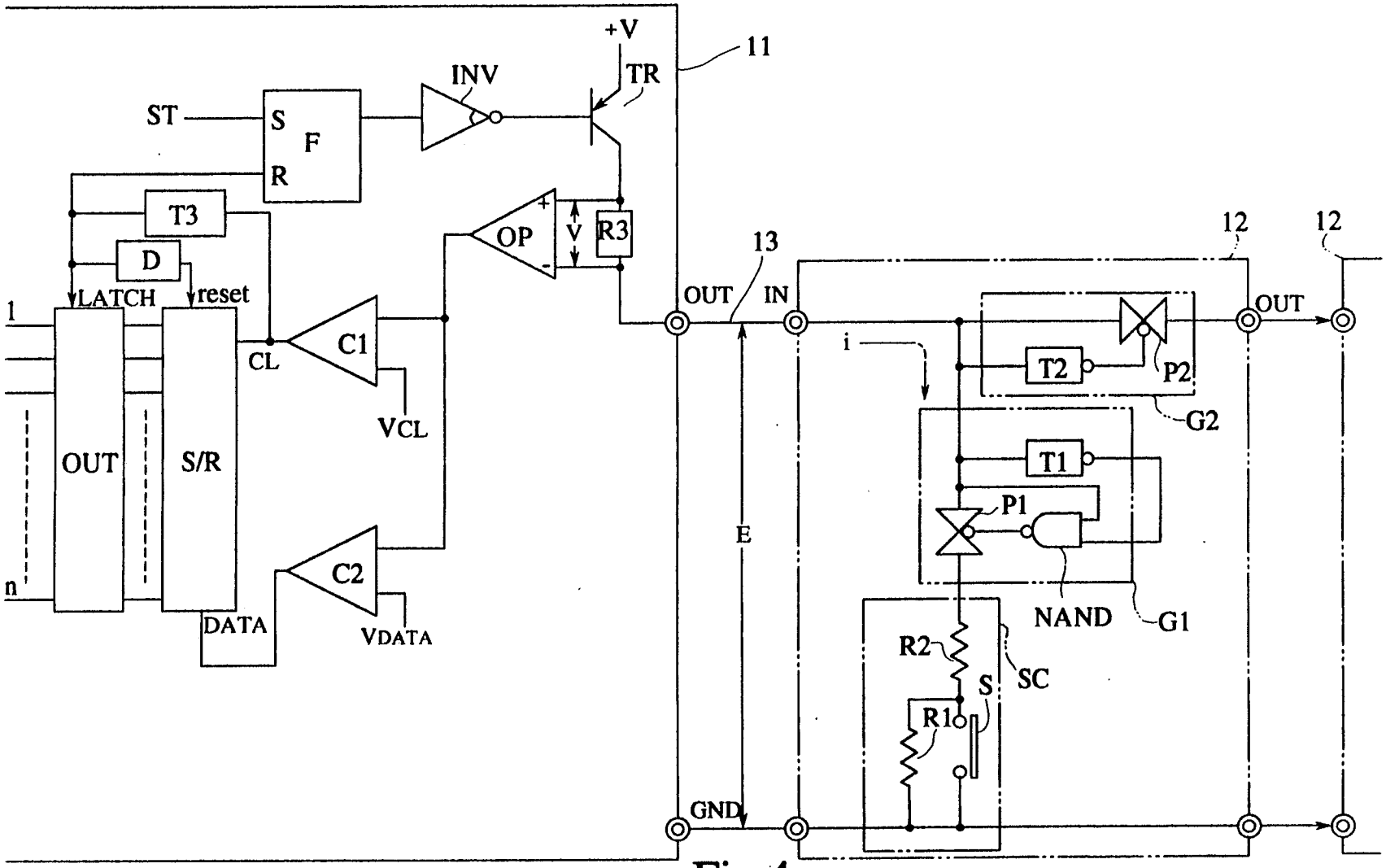
FIG. 4 is a view showing the arrangement of further embodiment of the invention.

FIG. 4 illustrates the arrangement of still another embodiment of the data transmission system according to the present invention.

In the figure, reference numeral 11 denotes a controller, to which 128-channel (128-stage) sensor terminals 12 are connected in total. The sensor terminals 12 each comprise a first gate circuit G1, a second gate circuit G2, and a sensor circuit SC.

In the first gate circuit G1, a timer T1 is actuated when the input terminal IN is connected to the current source, holding the switch element P1 in the ON state until a specified time T1 elapses. When the specified time T1 has elapsed, the output of the timer T1 goes LOW with the NAND gate closed, thereby turning off the switch element P1. During this specified time T1, a current i flows from the input terminal IN to the sensor circuit SC. At this point, if the sensor S is in the ON state, the current i is such that $i = E / R2$, and if in the OFF state, that $i = E / (R1\ R2)$.

The second gate circuit G2 is composed of a switch element P2 inserted in the current line in series and a timer T2. The set time of the timer T2 is longer than that of the timer T1 so that the switch element P2 will turn on after an elapse of a time interval $(T2 - T1)$ from when the switch element P1 is turned off. This second gate circuit G2 allows the input terminal IN, i.e. the current source side to be connected to the output terminal OUT, i.e. the load side after an elapse of a specified time T2 from when the input terminal IN is connected to the sensor circuit SC.

Figure 5:
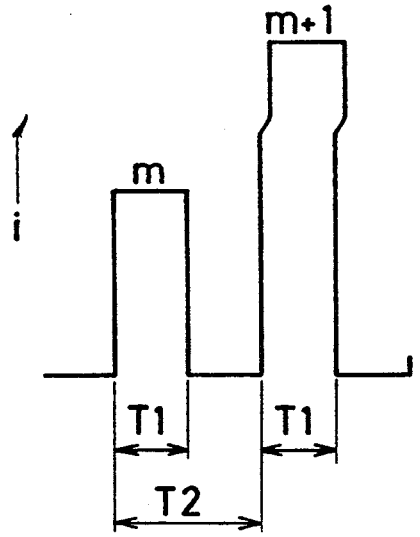
FIGS. 5, 6, and 7 are views for explaining the operation of the same embodiment.

FIG. 5 illustrates the variation in the current i flowing through a current line 13 for one time interval. This example shows that the sensor S in the mth-channel sensor terminal 12 is OFF, while the sensor S in the $(m+1)$th-channel sensor terminal is ON.

The sensor circuit SC is composed of the sensor S, and resistors R1, R2 making up a variable impedance circuit, the arrangement being such that when the sensor S is in the ON state, the sensor circuit has a resistance value of R2, while when the sensor S is in the OFF state, it has a resistance value of $(R1+R2)$.

Figure 6:
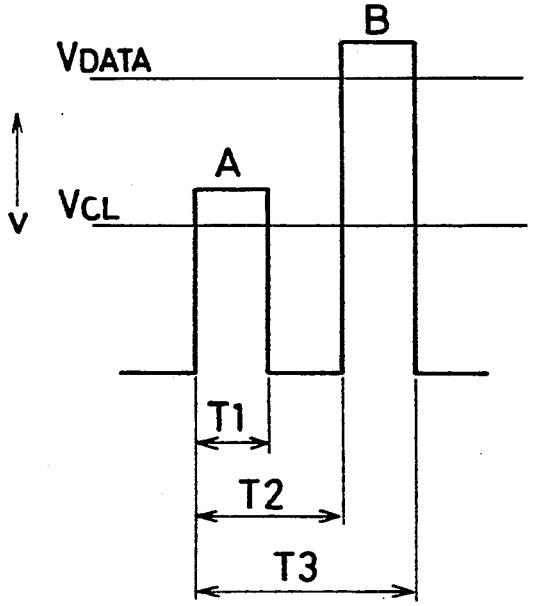

The controller 11 supplies current to the current line 13 by means of a transistor TR connected to a power supply +V. To the current line 13 there is inserted a resistor R3 for voltage-current conversion, with an arrangement that a voltage drop of the resistor R3 is detected by an operational amplifier OP, the output of which is detected comparators Cl, C2. These resistor R3, op-amp OP, and comparators C1, C2 constitute a current detector circuit. To the comparators C1, C2 there are set reference voltages VCL, VDATA, respectively, which reference voltages are of the levels as shown in FIG. 6. That is, indicatory characters A and B in the figure show the voltages across the resistor R3 which occur when the sensor S is in the OFF state and when in the ON state, respectively, in any one sensor terminal 12. In this arrangement, VCL is set to such a level that allows the detection of the fact that a voltage drop has occurred across the resistor R3 due to the current i flowing into the sensor circuit SC, while VDATA is set to such a level that allows the detection of a voltage drop across the resistor R3 occurring when the sensor S turns on in a sensor terminal 12. The output of the comparator C1 is supplied as clocks for a shift register S/R, and further for actuating a timer T3.

The set time of the timer T3 is determined so as to be at least longer than that of the timer T2, as shown in FIG. 6, and is provided by a trigger timer circuit. The timer T3 will not run out for the set time while it is continuously driven by the output of the comparator C1; but it will when the output of the comparator C1 suspends, which is detected as the final-channel sensor terminal 12. More specifically, after an elapse of a specified time T3 from when a current is supplied to the final-channel sensor terminal 12, the output of the timer T3 will rise. The output of the timer T3 is sent to both the reset terminal of a flip-flop F and the latch terminal of an output circuit OUT, and moreover sent to the reset terminal of a shift register S/R via a delay element D. The set terminal S of the flip-flop F has a start signal ST transmitted thereto from another circuit power when a specified time elapses after power-on or a time-up of the timer T3, and the set output of the flip-flop F is led to the base of the transistor TR through an open-collector type inverter INV. When the start signal ST is issued to set the flip-flop F, the transistor TR turns on; thereafter, when the output of the timer T3 goes HIGH to reset the flip-flop F, the transistor TR turns off to terminate the sensing cycle. Meanwhile, the output of the timer T3 serves to latch the contents of the shift register S/R to the output circuit OUT, while it forms a reset signal by the medium of the delay element D to reset the shift register S/R.

The output of the comparator C2 is entered into the shift register S/R as data. As the output of the comparator C1 has been entered into the shift register S/R as clocks, the shift register S/R receives an input of 0 for the detection of the voltage A in FIG. 6, while it receives an input of 1 for the detection of the voltage B. The number of stages of the shift register S/R is set to one at least more than the total number of the sensor terminals 12, their outputs being latched in parallel to the output circuit OUT.

In the controller having such an arrangement as described above, when the start signal ST is supplied at first, the flip-flop F is set so that a current is supplied from the transistor TR to the current line 13, thereby causing a sensing cycle to start. Then, it is followed by sensing the ON/OFF state of the sensors S in order starting with that of the first sensor terminal 12 for every time interval T2 thereafter, i.e. by detecting the amount of voltages v across the resistors R3. If the sensor S is in the OFF state, only the output of the comparator C1 goes HIGH, causing an input of 0 to enter the shift register S/R. In contrast to this, if the sensor S is in the ON state, both the outputs of the comparators C1 and C2 go HIGH, causing an input of 1 to enter the shift register S/R. As a result of this operation being repeated, the shift register S/R stores 1s in conjunction with only those stages that correspond to the sensor terminals in which the sensor S is in the ON state, while it stores 0s in conjunction with those which correspond to the other sensor terminals. After that, when sensing is completed with the final-channel sensor terminal, the timer T3 runs out to reset the flip-flop F, causing the contents of the shift register S/R to be latched to the output circuit OUT, and moreover causing the shift register S/R to be reset after some delay. This is all of one-cycle sensing operation.

With the above sensing operation completed, the state of the sensor circuit in each sensor terminal 12, i.e. the ON/OFF state of the sensors S can be known by looking at the state of the terminals 1 through n of the output circuit OUT.

Figure 7:
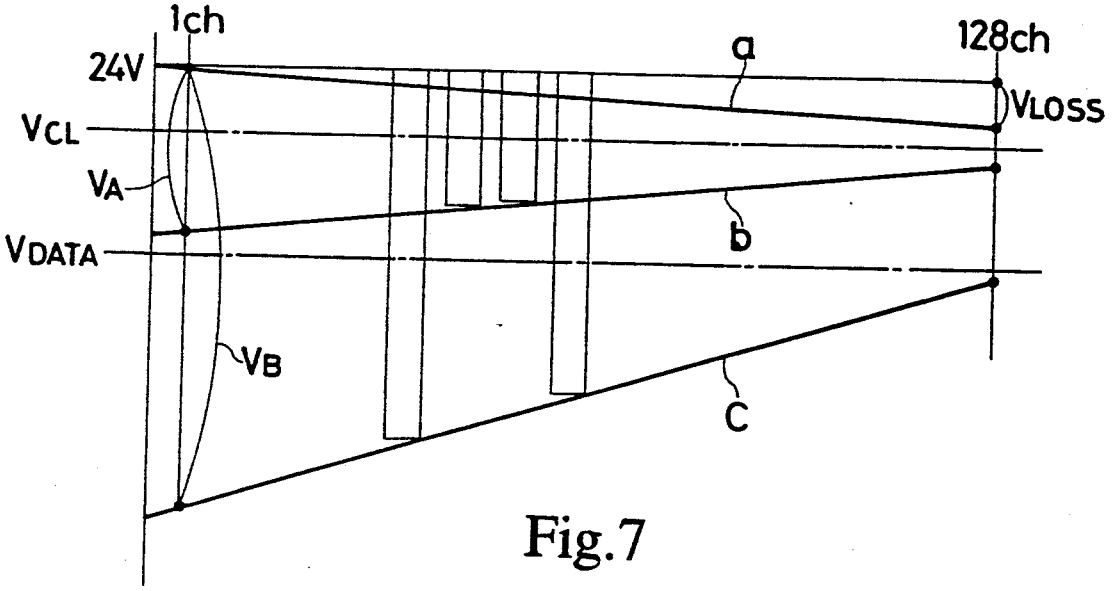

In the operation described above, while sensing is being effected to the mth-channel sensor terminal, the current i is not flowing through the sensor terminals 12 of the first-to (m−1)th channels. This obviates any wasteful power consumption, and therefore even if a larger number of sensor terminals 12 are involved, the amount of the current that flows through the current line 13 from the controller 11 will not increase. If the power consumption in each sensor terminal 12 reaches some large extent, the farther the position of a sensor terminal 12 being subjected to sensing, the greater the voltage drop across the switch element P2 in each sensor terminal 12 located ahead thereof, causing the current flowing through the current line 13 to be increased. What is more, there arises a problem that the ratio of voltage change across the resistor R3 based on the ON/OFF operation of the sensor S is lessened such that the farther the sensor terminal is, the less accurately the ON/OFF state thereof can be detected. In the present embodiment of the invention, however, since there is no wasteful power consumption involved in sensor terminals other than that being subjected to sensing, the current flowing through the current line 13 is of a small amount enough to allow the accurate detection of the ON/OFF state of the sensors even on the succeeding stages. Incidentally, in the case where a semiconductor device is used as the switch element P2, even with not large a current flowing through the current line 13, the voltage drop across this switch P2 is not zero. For this reason, for example, if the number of channels connected to the current line 13 is 100 or more and if the power supply +V is approximately 24 volts, it may happen that while sensing is being effected to a farther-stage sensor terminal 12, the sum of voltage drops across the switch elements P2 in the sensor terminals 12 located ahead thereof reach an appreciable amount. In such a case, it is necessary to set the reference voltages VCL and VDATA to such levels as shown in FIG. 7, where the total number of sensor terminals 12 is 128 and the power supply +V is 24 volts by way of example. In this figure, the lateral axis represents the number of sensor terminals 12 in which their switch elements P2 are in the ON state, while the vertical axis does the voltage v across the resistor R3. Likewise, reference character a shows the sum of voltage drops across switch elements P2; b does a detected voltage v of the resistor R3 while the sensor S in each sensor terminal 12 is in the OFF state; and c shows a detected voltage v of the resistor R3 while the sensor S in each sensor terminal 12 is in the ON state. As shown in the figure, while the final-stage (128th channel) sensor terminal 12 is under sensing, the sum of voltage drops across switch elements P2 reaches a considerably large amount, with the result that the detected voltages b and c of the resistor R3 in the 128th-channel sensor terminal 12 based on the ON/OFF state of the sensor S is lessened such as shown in the figure. Accordingly, for the setting of the VCL and VDATA, it is required to set VA and VB in the 128th channel to identifiable amounts.

If a MOSFET having a smaller ON-state resistance is used as the switch element P2, the voltage drop in the gate circuit can be reduced, allowing larger margins to be accompanied to the above-mentioned VCL and VDATA. Moreover, the value of current that flows through the current line 13 may be reduced, as well.

Figure 8A:
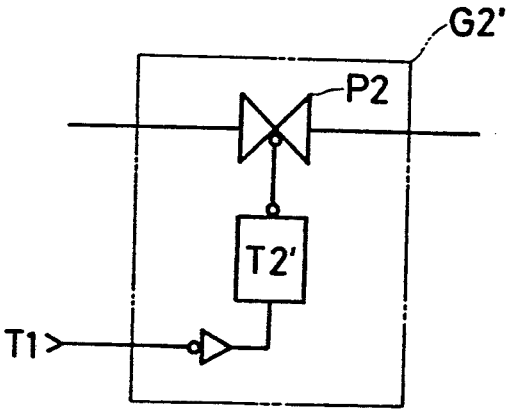
FIGS. 8 (A) and (B) are views partially showing the arrangement of even further embodiment.
Figure 8B:
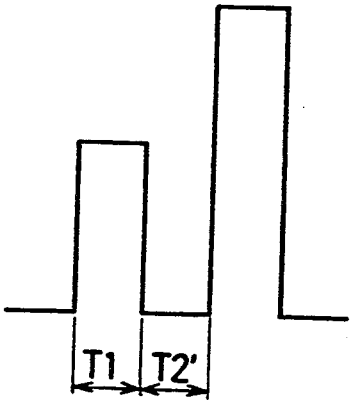

In addition, the aforementioned second gate circuit G2 may also be arranged such as shown in FIG. 8 (A). In this example, the arrangement is such that a timer T2' is actuated on the reception of the output of the timer T1 and turns on the switch element P2 after a specified time T2'. The relation between the set time T1 of the timer and the time T2' is as shown in FIG. 8 (B).

Further, in the controller 11, the voltage across the resistor R3 may be A/D converted to process in the CPU, where the output can be led out to external through an RS232C terminal. As for the sensor S in the sensor circuit SC, there are photoelectric sensors or the like available in addition to micro switches; moreover, a sensor may also be used the output of which varies linearly.

Figure 9:
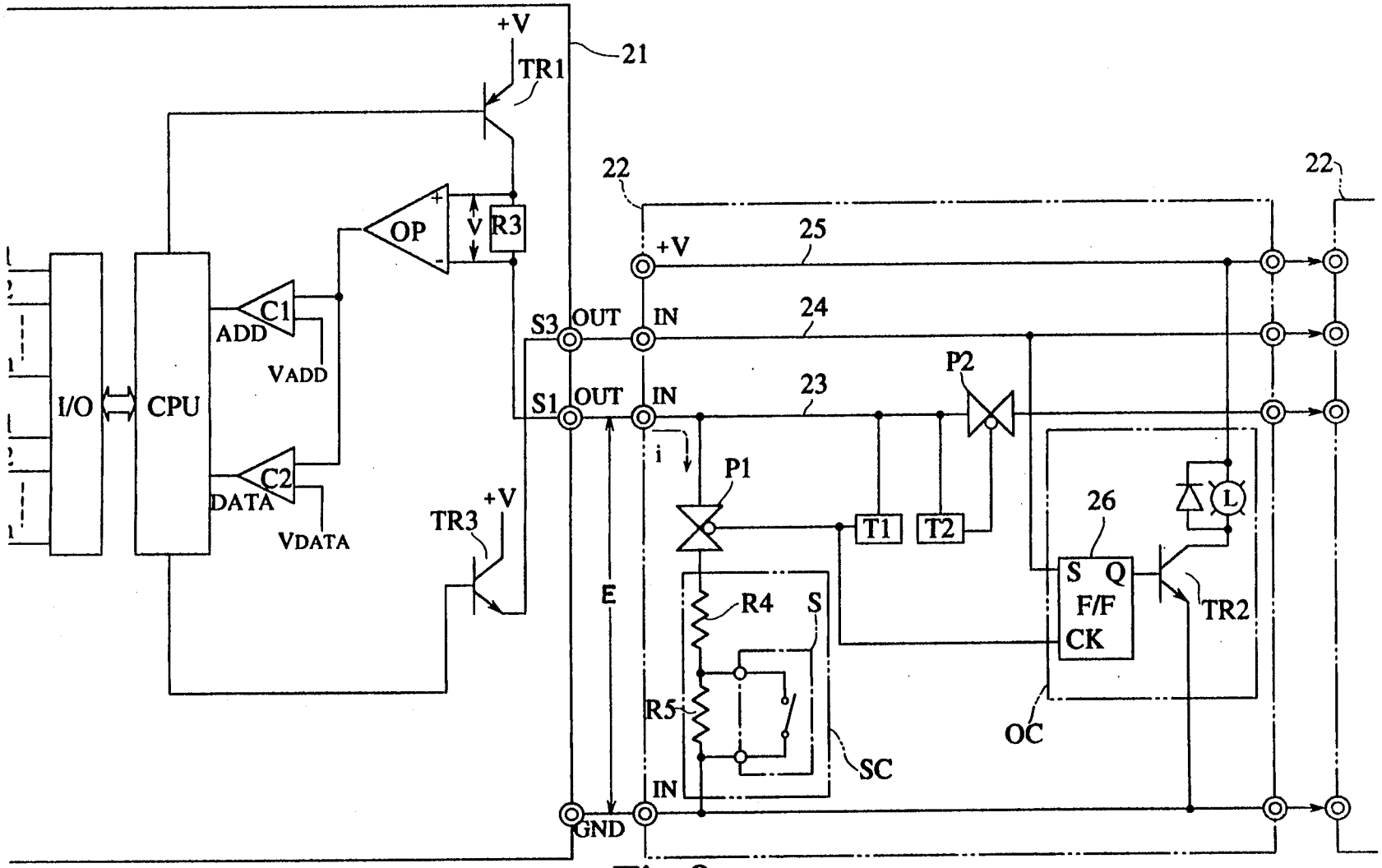
FIG. 9 is a view showing the arrangement of still another embodiment of the invention.

FIG. 9 illustrates the arrangement of a data transmission system of still another embodiment of the present invention.

To a controller 21 having the same arrangement as in FIG. 4, there are connected 128-channel (128-stage) sensor terminals in all. Each sensor terminal 22 is connected with both a current line 23 and a data transmission line 24 in cascade to the controller 21. Each of the sensor terminals 22 comprises: a first gate circuit composed of a switch element P1 and a timer T1; a second gate circuit composed of a switch element P2 and a timer T2; a sensor circuit SC composed of resistors R4 and R5, which provides a variable impedance circuit, and a sensor S; and an output circuit OC including an output lamp L and a transistor TR2. In the output circuit OC there is provided a flip-flop 26. In the first gate circuit, the timer T1 is actuated when an input terminal IN is connected to the current source of the controller 21, the switch element P1 being held in the ON state until the specified time T1 elapses. When the specified time T1 elapses, the output of the timer T1 goes LOW, turning off the switch element P1. During the specified time T1, therefore, a current i begins to flow from the input terminal to the sensor circuit SC. At this point, if the sensor S is in the ON state, the current i is that $i=E / R4$, and if in the OFF state, that $i=E / (R4+R5)$.

The set time of the timer T2 forming the second gate circuit is longer than that of the timer T1 so that the switch element P2 will turn on after an elapse of a time interval (T2 −T1) from when the switch element P1 is turned off. After an elapse of the specified time T2 from when the input terminal is connected to the sensor circuit SC by the second gate circuit, the input terminal, i.e. the current source side will be connected to the output terminal, i.e. the load side.

Figure 10A:
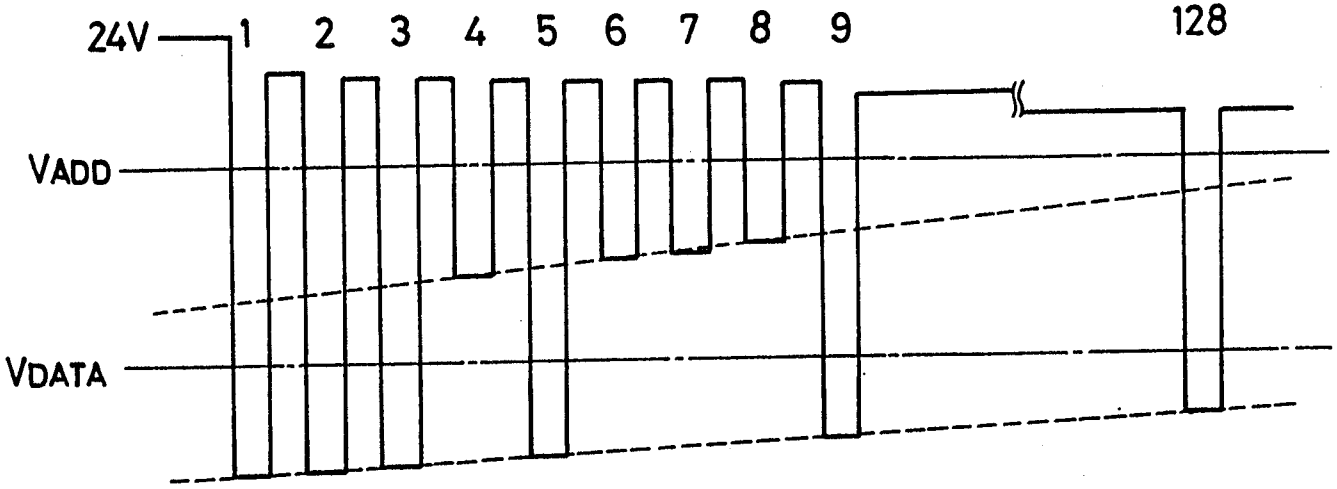
FIGS. 10 (A) to (C) are views showing input waveforms entered into the controller.
Figure 10B:
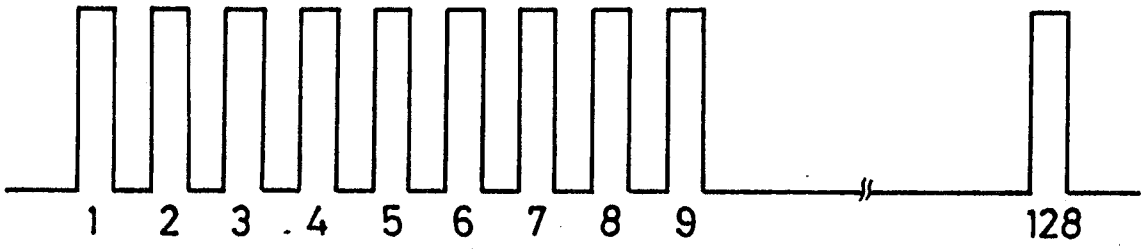
Figure 10C:
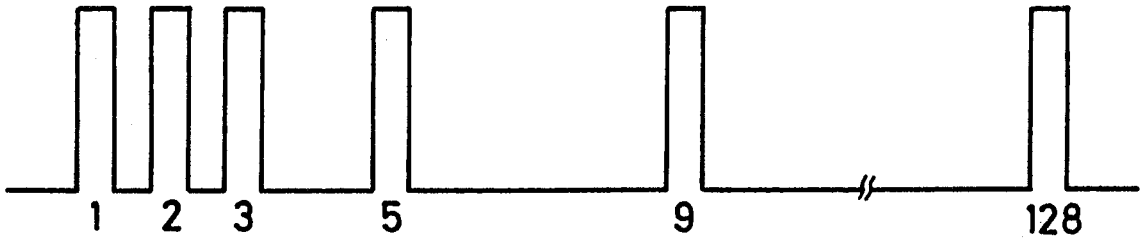

The output of the timer T1 is entered also into a clock terminal ck of the flip-flop 26 included in the output circuit OC. The flip-flop 26 puts out the state of a set terminal s on the trailing edge of the clock terminal ck from an output terminal Q to the transistor TR2. In each sensor terminal 22, the output lamp L is connected to a power line 25 in parallel and, when an "H" signal is inputted into the set terminal of the flip-flop 26 while the timer T1 is counting the time T1, the transistor TR2 turns on, thus making the output lamp L lit. With the above arrangement, the controller 21 is capable of detecting the ON/OFF state of the sensor S in each sensor terminal 22 by detecting the voltage across the resistor R3 through the same operation of circuits as in FIG. 4. For example, if the controller 21 undergoes a change in the voltage across the operational amplifier OP as shown in FIG. 10 (A), the CPU receives such an input of waveform as shown in FIG. 10 (B) as an address signal, while receiving an input of waveform as shown in (C) as a data signal. Accordingly, depending on the signal inputted to the ADD terminal of the CPU, the CPU can determine the sensor terminals 22 in which the switch element of the first gate circuit thereof has turned ON, and moreover, depending on whether or not a data signal exists at that time, it can detect whether or not the sensor S included in the relevant sensor terminal 22 is in the ON state.

When the controller 21 puts out a signal through a transistor TR3 to the data transmission line 24 while the timer T1 is counting the time T1, the output lamp goes on. The current source side of the controller 21 will be connected to a succeeding-stage sensor terminal 22 step by step for every interval of the time T2 counted by the timer T2. Accordingly, by putting out the signal to the data transmission line 24 at a timing obtained by multiplying the number of stages of sensor terminals to which data is output by the time T2, the controller can make lit the output lamp L in any desired connection terminal 22. In this case, through the operation of the flip-flop 26, the output lamp L once lit will go out if no signal is put out to the data transmission line 24 on the trailing edge of the output of the timer T1 during the next sensing operation.

In the above-mentioned sensor terminals 22, it may also be arranged that a flicker circuit is provided between the flip-flop 26 and the transistor TR2 so as to flicker the output lamp L.

In such a way as described above, the sensor terminal 22 can be used as an input/output unit. For example, such an arrangement is also allowable that the operating state of a motor or the like is detected by the sensor S and displayed by the output lamp L included in the relevant sensor terminal 22 being lit. In this case, the CPU is adapted to put out an ON signal for the output lamp L when receiving an input of a data signal. Further, if the sensor S forming part of the sensor circuit SC is separated apart, the sensor terminal 22 can be used as an output unit. In this case, the CPU does not receive such input of a data signal as shown in FIG. 10 (C), but puts out an ON-signal at a predetermined timing with reference to an address signal as shown in FIG. 10 (B), according to a signal entered form external through an I/0 device.

Figure 11A:
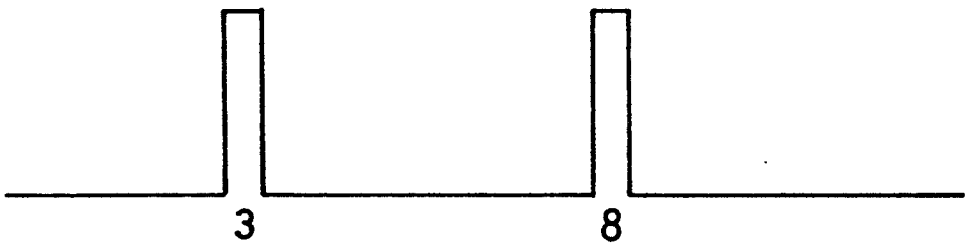
FIGS. 11 (A) to (C) are views showing an input waveform entered into the controller from external and the waveform of ON-signal corresponding to this input in the same embodiment.
Figure 11B:
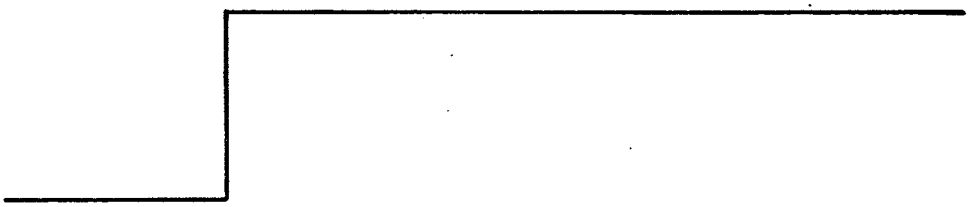
Figure 11C:
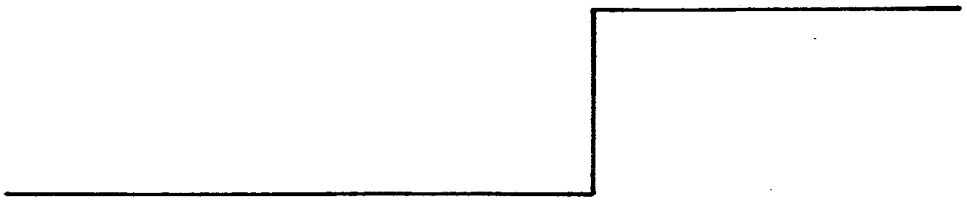

As an example, if setting input data as shown in FIG. 11 (A) has already been entered, the CPU puts out ON-signal at an entrapping timing such as shown in FIG. 10, and then the flip-flops 26 in the third-stage and eighth-stage sensor terminals 22 put out ON-data, as shown in FIG. 11 (B) and (C).

In addition, if a MOSFET having a smaller ON-state resistance is used as the switch element, the same effect as in the arrangement shown in FIG. 4 can be obtained by virtue of its voltage drop and gate current reduction.

Figure 12:
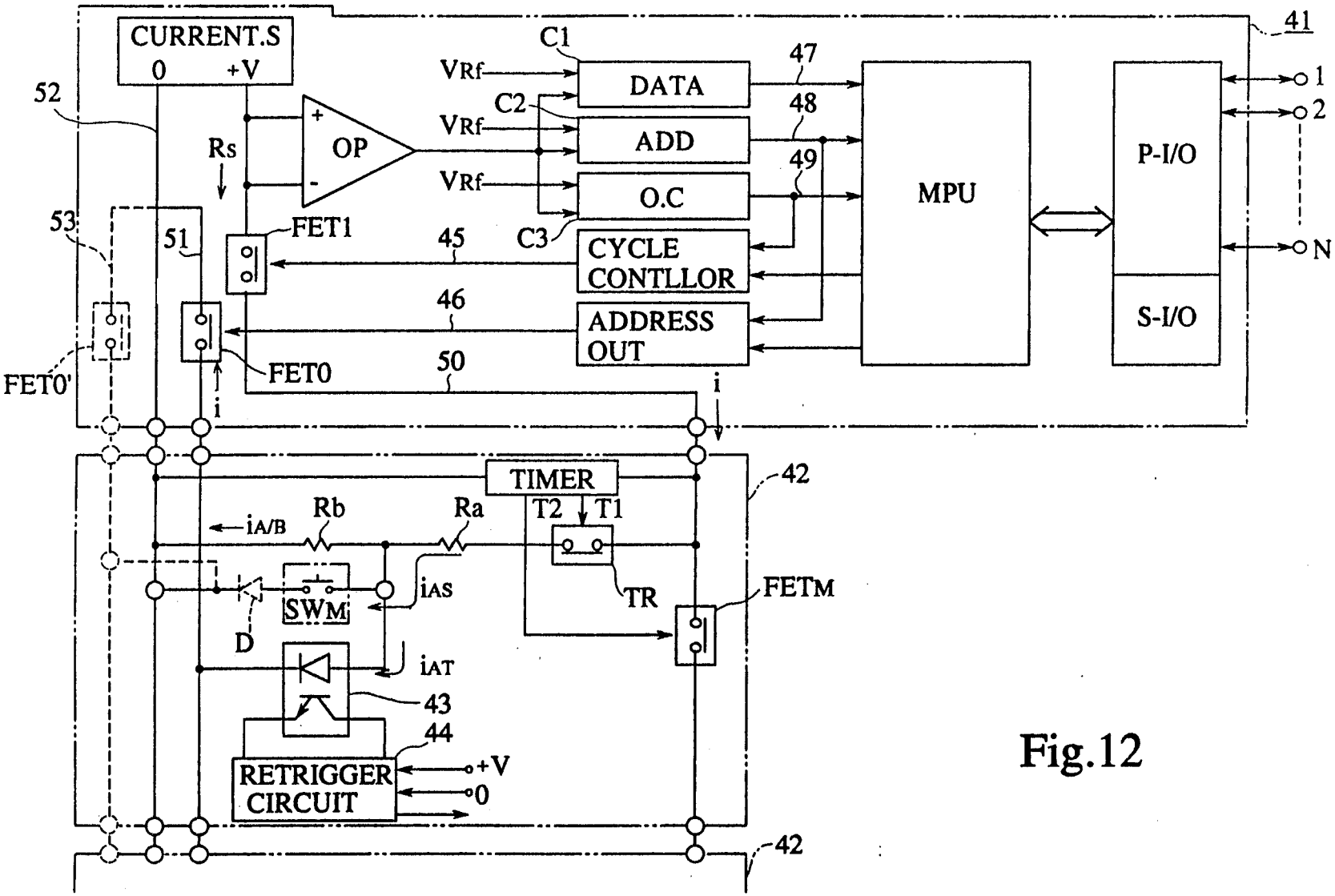
FIG. 12 is a view showing the arrangement of still further embodiment of the invention.

FIG. 12 illustrates the arrangement of still another embodiment of the data transmission system according to the present invention.

To a controller 41 there is connected a plurality of sensor terminals 42 in cascade. The controller 41 detects voltage drop across a resistor RS, which is inserted in the current line 50 for use of current-voltage conversion, through an operational amplifier OP, comparing its output with reference voltages of comparators C1 through C3. Reference voltages VRf set to each of the comparators C1 and C2 are equivalent to the reference voltages VDATA and VADD in the foregoing FIG. 10 and FIG. 13 (B), respectively, and moreover, in the current line 50, they correspond to the currents designated by (2) and (1) shown in FIG. 14, respectively. On the other hand, a reference voltage VRf set to the comparator C3 is rendered larger than the reference voltages set to the comparators C1 and C2, corresponding to the current designated by (5) in FIG. 14 in the current line 50. This allows the comparator C3 to detect an over voltage due to short-circuit or the like.

Figure 13A:
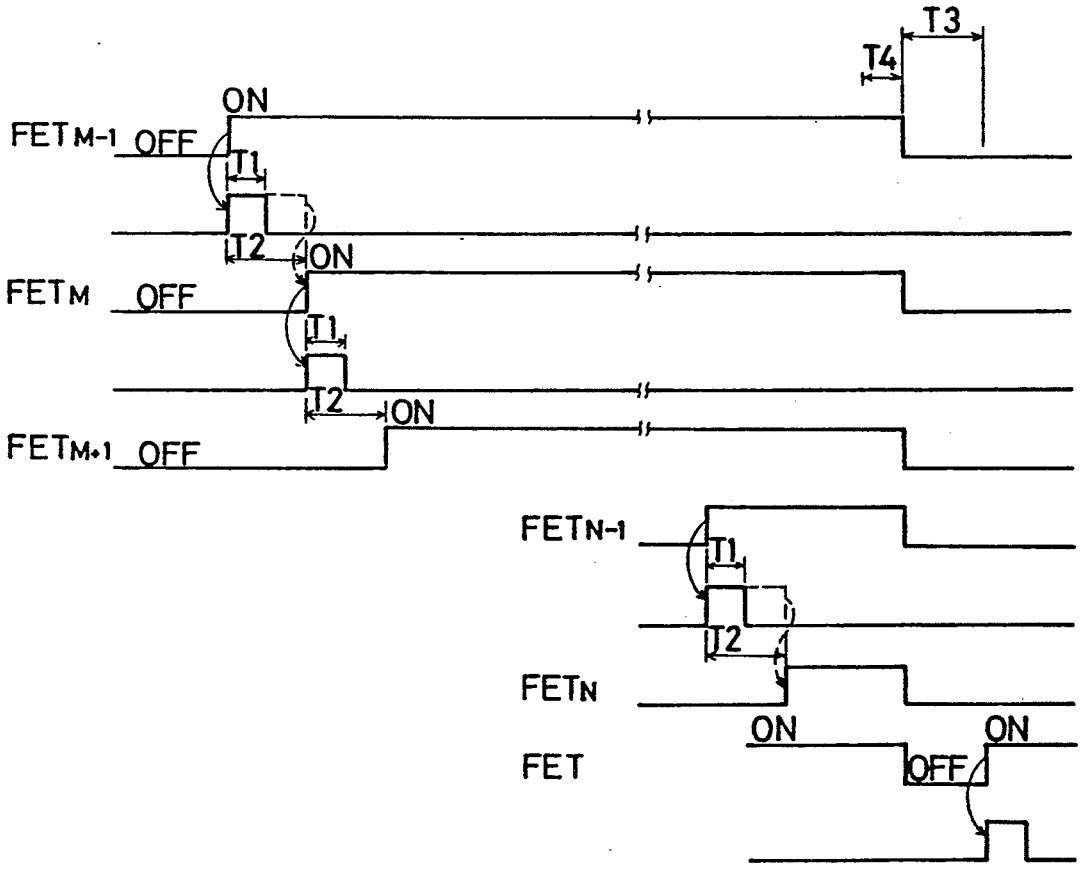
FIGS. 13 (A) and (B) are views showing ON/OFF state of a current line in each sensor terminal and the output voltage of the operational amplifier in the same embodiment.
Figure 13B:
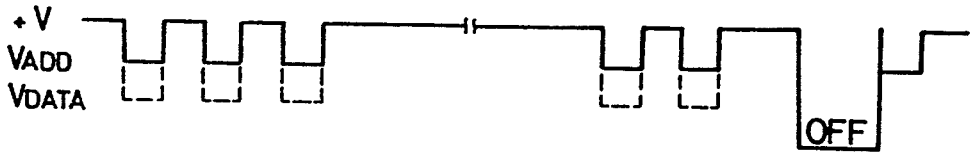
Figure 14:
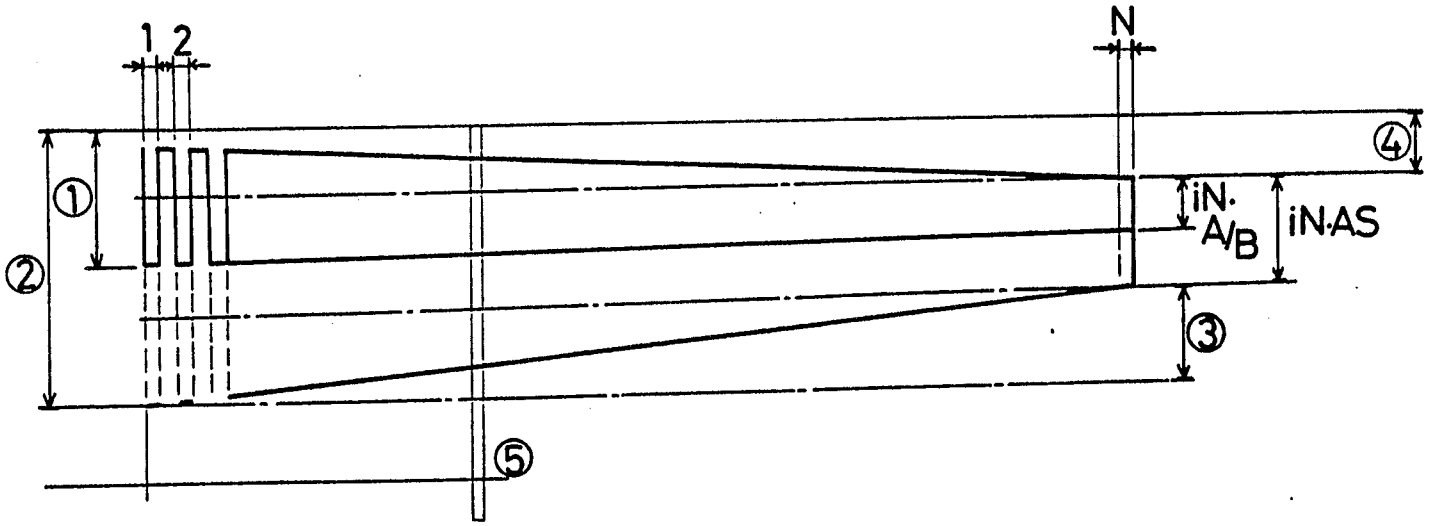
FIG. 14 is a view showing the detection state of current in the current line in the controller of the same embodiment.

A microprocessor unit MPU of the controller 41 supplies a signal 45 to FET 1 through a cycle controller. With the signal 45 supplied, the FET 1 turns on, causing a sensor terminal 42 to be connected to the power supply through the current line 50. Each sensor terminal 42 has a timer for counting time T1 or T2, which timer turns off a transistor TR after an elapse of the time T1, and turns on FETM after an elapse of the time T2. Accordingly, as shown in FIG. 13 (A), the power supplied to the Mth-stage sensor terminal 42 is further supplied to the (M+1)th-stage sensor terminal after an elapse of the time t2. Meanwhile, to the sensor terminal 42 there is provided a sensor circuit composed of resistors Ra, Rb, and a sensor SWM, in which the resistance value of the sensor circuit becomes Ra while the sensor SWM is ON, and (Ra Rb) while OFF. As a result, during the OFF state of the sensor SWM, a current iA/B flows through the current line 50; during the ON state thereof, a current iAS flows. By current-voltage converting the value of the current that flows through the current line 50 and detecting it with the operational amplifier OP, both the address (number of loaded stages) of the sensor terminal 42 and data (ON-signal for the sensor SWM) can be detected. This allows the controller 42 to detect the value of the current flowing through the current line 50 in such a state as shown FIG. 14.

When the sensor terminal 42 is used as an output unit, a photo coupler 43 is connected thereto in place of the sensor SWM. A photo diode forming the photocoupler 43 is connected from a current line 51 to a common terminal of the power supply through FET 0. The FET 0 is turned on by a signal 46 output from the MPU. With the sensor SWM disconnected (or, even if connected, held OFF), when the signal 46 is output to turn on the FET 0, the current flowing through the current line 50 is equal to a driving current iAT for the photo diode, allowing the photo diode forming the photocoupler 43 to turn on. Since the MPU can determine a sensor terminal which is being powered with the aid of an output 48 of the comparator C2, it produces the signal 46 to turn on the FET 0 at a predetermined timing so as to turn on the photo diode of the photocoupler 43 in a desired sensor terminal 42, thus allowing the sensor terminal 42 to be used as an output unit. In the above arrangement, the transmission driving output current iAT is of the same amount as that of a sensor detecting current iAS used as a receiving unit, both transmission and reception can be performed under the same conditions enough to ensure positive data transmission. Accordingly, each of a plurality of sensor terminals can be used as both an input unit and an output unit, where the conditions with respect to current flowing through the current line 50 is all the same.

Each sensor terminal 42 includes a retrigger circuit 44 for receiving power supply from external, to which retrigger circuit is connected a photo transistor of the photocoupler 43. The retrigger circuit 44 puts out a switching signal when the photo transistor turns on. The provision of the photocoupler 43 and the retrigger circuit 44, as shown above, allows the signal to be output from the sensor terminal 42 used as an output unit. Moreover, connecting the sensor SWM from the current line 53 with FRT 0' interposed therein through a diode D to the common terminal allows the sensor terminal 42 to be used as an input/output unit. In this case, the retrigger circuit 44 is supplied with power by a route other than the current line 50, and therefore the driving voltage for the retrigger circuit 44 will not affect the voltage detected by the operational amplifier OP, enabling the data transmission and reception and, further, the determination of addresses to be performed correctly in the MPU. More specifically, if a signal line and a power line are arranged to share a common line, as shown in FIG. 9, in order to supply power to the retrigger circuit 44, there arises a large voltage drop in the common line when a large number of retrigger circuits are simultaneously turned on; however, if the retrigger circuits are driven by another power supply as in this embodiment, the above problem can be solved, allowing the data transmission and reception as well as the determination of addresses to be performed correctly. In addition, as the power source for driving the retrigger circuits, a battery or a power unit of external controlled equipment can be used.

Figure 15A:
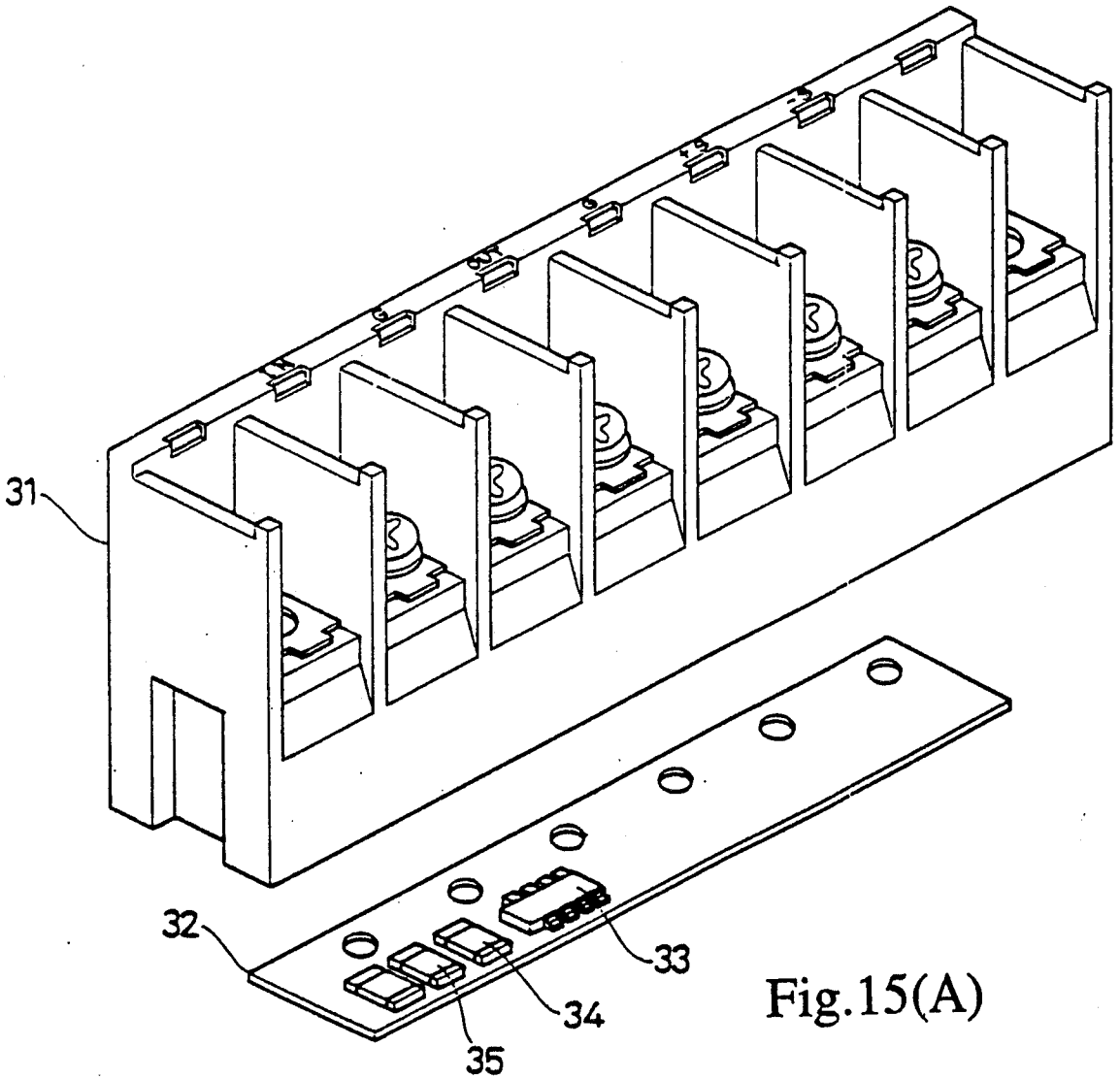
FIGS. 15 (A) and (B) are assembly drawings of an embodiment of the invention as viewed from the front and rear thereof, respectively.
Figure 15B:
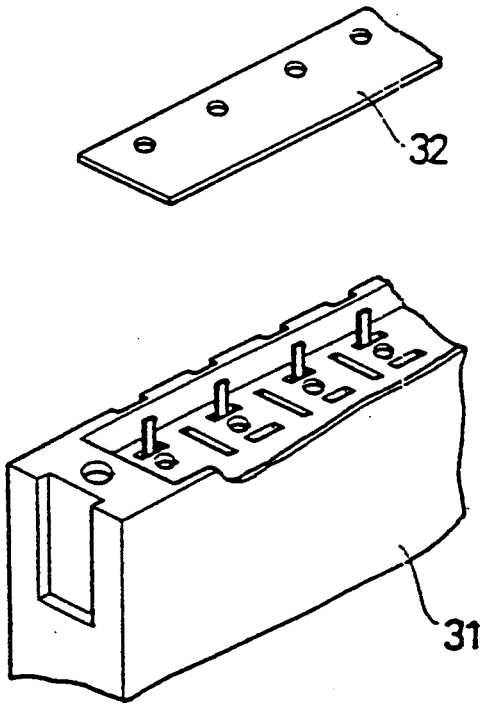

FIGS. 15 (A) and (B) are assembly drawings of the main part of the data transmission system of the invention, as viewed in the front direction and rear direction, respectively.

To a PCB mounted to the rear side of a terminal block 31 there are provided an IC chip 33, which forms the gate circuit and switching circuit, and resistors 34 and 35, which form part of the sensor circuit. And to the terminal block 31 there is provided a sensor terminal 22 integrally thereto. Such a construction can advantageously simplify the installation work at sensor terminals in association with each work station that forms a LAN system or others.

Figure 16:
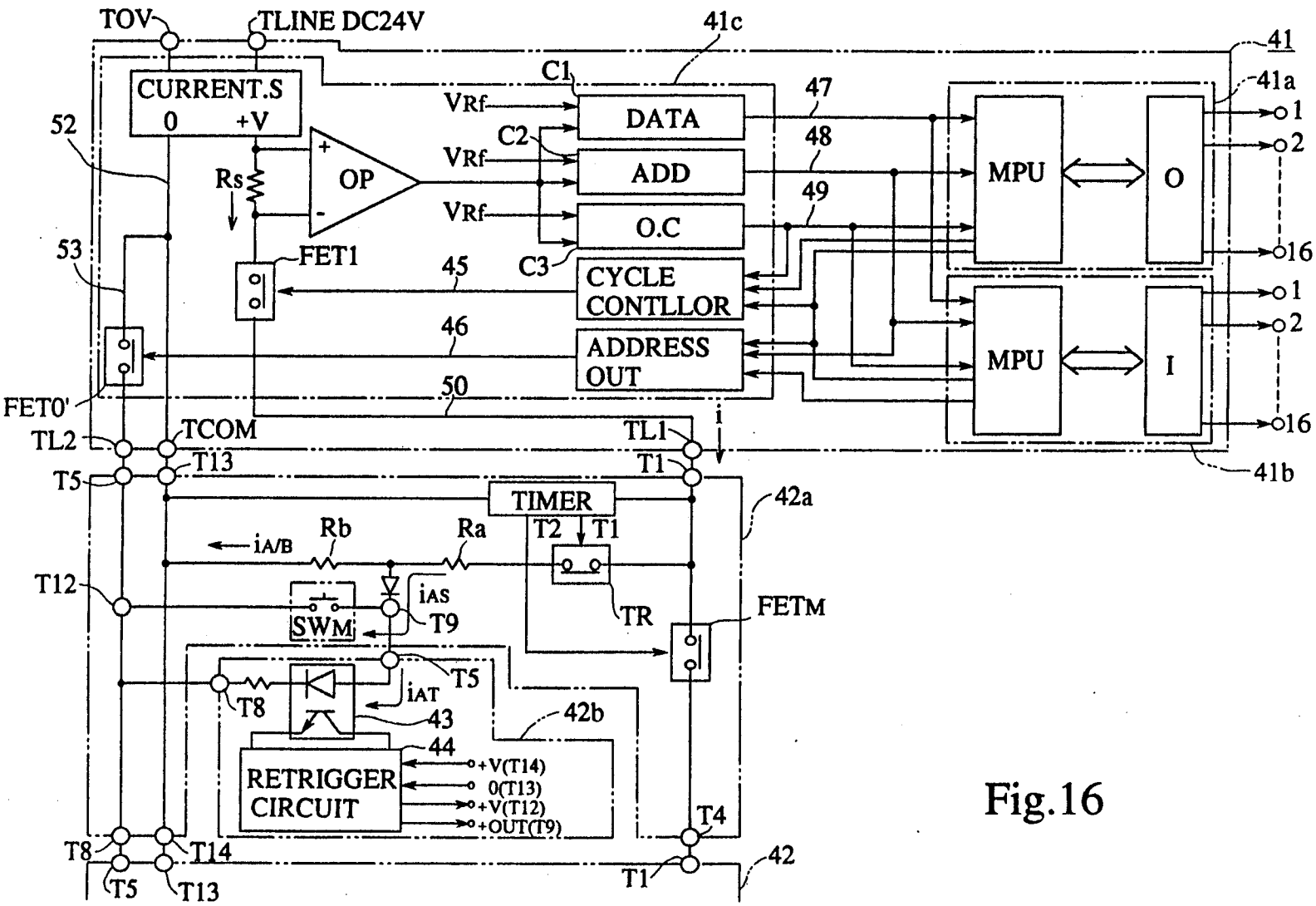
FIG. 16 is a view showing the arrangement of a still more embodiment of the invention.

FIG. 16 illustrates the arrangement of further embodiment of the data transmission system according to the present invention. A controller 41 comprises: a reception control unit **41*b* having 16 channel input terminals; a transmission control unit 41*a* having 16 channel output terminals; and a decision control unit 41 composed of the rest of the portions. The sensor terminal 42 is provided by either an input unit 42*a* in which the sensor can be connected to terminals T9 and T12 or an output unit 42*b* in which the output element can be connected to terminals T9 and T12. The output unit 42*b* is externally supplied with power at its terminals T13 and T14. To connect the output unit 42*b* to the current line 50 (i.e. L1), terminals T5 and T8 of the output unit are connected to the terminals T9 and T12 of the input unit 42*a***, as shown in the figure.

Figure 17:
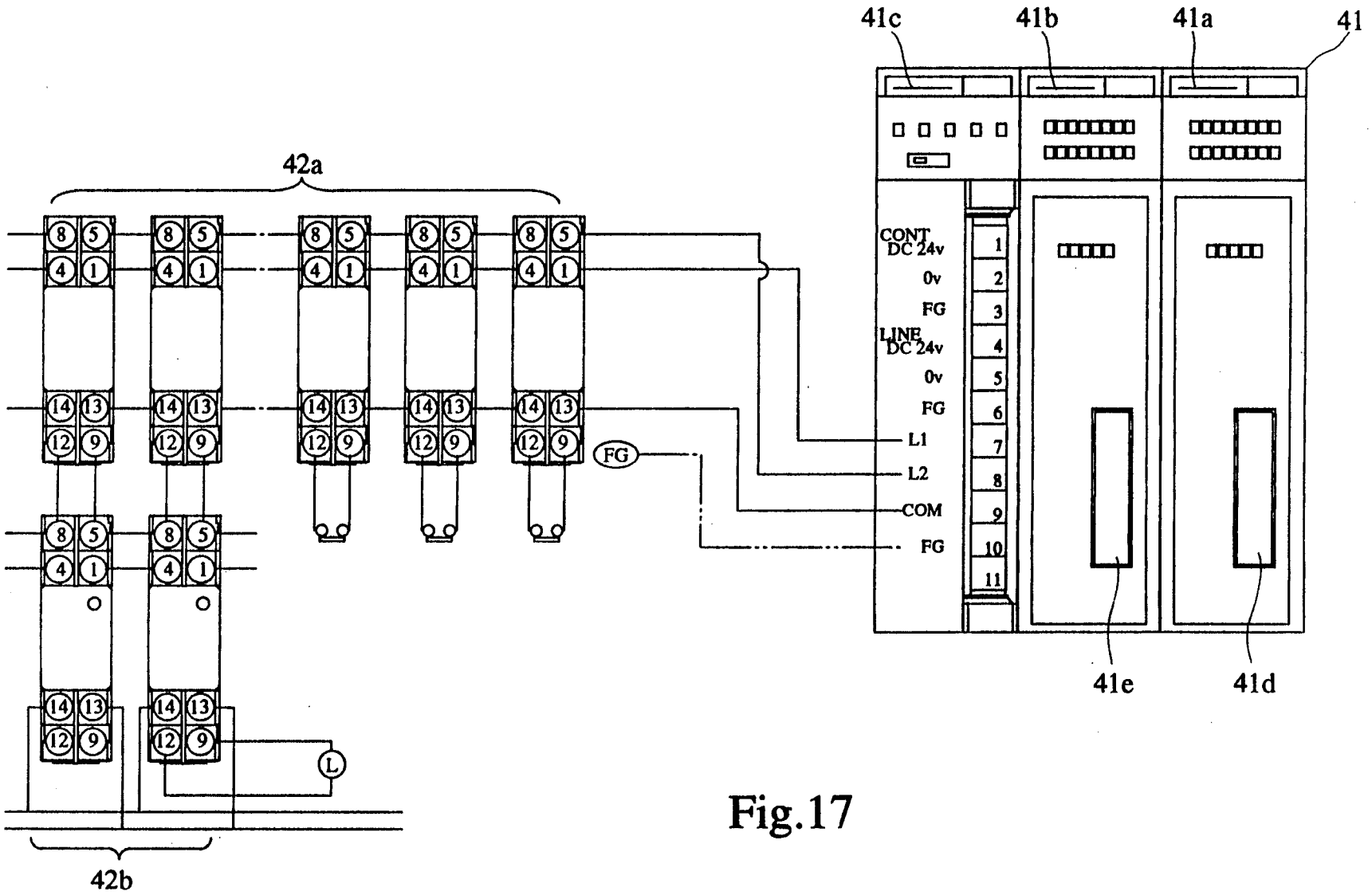
FIG. 17 is a view showing the connection between the controller and sensor terminals.

FIG. 17 illustrates the connection diagram of each unit as mentioned above.

What is claimed is:

1. A data transmission system with double lines comprising: a plurality of sensor terminals connected to a current line in cascade, each sensor terminal including:

(a) a sensor;

(b) a sensor circuit for changing an impedance depending on state of the sensor;

(c) a branch current line connected to the current line; and (d) switch means for connecting the current line to the sensor circuit for a specified time after a current begins to flow to the current input side of the sensor terminal, and for connecting the current line to the current output side of the sensor terminal after an elapse of the specified time; and a controller connected to the current input side of the first sensor terminal, the controller including:

(a) a current source for outputting a current to the current line;

(b) current detection means for detecting value of the current; and (c) means for deciding state of the sensor circuits in the sensor terminals.

2. A data transmission system with double lines as claimed in claim 1, said switch means comprising:

a first switch element connected between said sensor circuit and said current line;

a second switch element connected to said current line in series;

timer means for counting up said specified time after said current begins to flow to the current input side of said sensor terminal, and thereafter for turning the second switch element on; and gate means for holding the first switch element off until the timer means counts up said specified time after said current begins to flow to the current input side of said sensor terminal.

3. A data transmission system with double lines as claimed in claim 1, said switch means comprising:

a first gate means which includes (a) a first switch element connected between said sensor circuit and said current line;

(b) a first timer means for counting a specified time T1 after said current begins to flow to the current input side of said sensor terminal; and (c) gate means for holding the first switch element on for the specified time T1 after said current begins to flow to the current input side of said sensor terminal, based on output of the first timer means; and a second gate means which includes (a) a second switch element connected to said current line in series; and (b) the second timer means for counting a specified time T2 (T2>T1), and for turning the second switch element on after counting up the time T2.

4. A data transmission system with double lines as claimed in claim 3, wherein said branch current circuit is connected to said first switch element in parallel.

5. A data transmission system with double lines as claimed in claim 1, said current detection means comprising:

current sensor means for detecting a current flowing through said current line;

an analog-digital converter for converting output of the current sensor means into digital data; and decision means for deciding state of said sensor in each sensor terminal based on the digital data.

6. A data transmission system with double lines as claimed in claim 1, said current detection means comprising:

a register connected to said current line in series;

a first comparator for comparing voltage drop of the register with a first reference value corresponding to a current flowing only through said branch current line;

a second comparator for comparing the voltage drop of the register with a second reference value corresponding to a current flowing through both said branch current line and said sensor circuit;

a shift register into which output of the first comparator is inputted as clock pulses and output of the second comparator is inputted as input data;

timer means adapted to start counting at each rise timing of the first comparator's output, for counting another specified time that is longer than said specified time;

means for turning said current source off when the timer means counts up the another specified time; and latch means for latching output of the shift register.

7. A data transmission system with double lines as claimed in claim 1, further comprising an output data transmission line and an output circuit for switching output state depending on whether or not output data is output to the output data transmission line while said current line is connected to said sensor circuit by said switch means.

8. A data transmission system with double lines as claimed in claim 7, further comprising power means for supplying power to said output circuit.

9. A data transmission system with double lines as claimed in claim 2, wherein each of said first switch element and second switch element is a MOSFET.

10. A data transmission system with double lines as claimed in claim 1, wherein at least one of said sensor terminals is mounted to a terminal block integrally.

* * * * *